US005279233A

United States Patent [19]

Cox

[11] Patent Number: 5,279,233

[45] Date of Patent: Jan. 18, 1994

[54] FOLDING TABLE MECHANISM

[75] Inventor: Lewis D. Cox, Knoxville, Tenn.

[73] Assignee: Falcon Products, Inc., Newport, Tenn.

[21] Appl. No.: 836,996

[22] Filed: Feb. 14, 1992

[51] Int. Cl.[5] ..... A47B 3/00

[52] U.S. Cl. ..... 108/129; 108/132; 248/439

[58] Field of Search ..... 108/129, 131, 132; 248/439

[56] References Cited

U.S. PATENT DOCUMENTS

| | | | |
|---|---|---|---|
| 1,571,807 | 2/1926 | Schmitt | 108/132 |
| 1,585,598 | 5/1926 | Miner | 108/132 |
| 1,593,975 | 7/1926 | Karstens | 108/132 |
| 1,956,946 | 5/1934 | Duffy | 108/132 |
| 1,959,725 | 5/1934 | Lindsay | 108/132 |
| 2,695,827 | 11/1954 | De Saussure, Jr. | 108/132 |
| 3,349,728 | 10/1967 | Barecki et al. | 108/131 |
| 3,818,844 | 6/1979 | Burr | 108/132 |
| 4,064,815 | 12/1977 | Baum | 108/129 |
| 4,444,124 | 4/1984 | Burr | 108/131 |
| 4,561,622 | 12/1985 | Heinzel . | |
| 4,653,804 | 3/1987 | Yoo et al. | 297/159 |
| 4,662,286 | 5/1987 | Barabas et al. | 108/17 |
| 4,827,851 | 5/1989 | Diffrient | 108/132 |
| 4,838,181 | 6/1989 | Luyk | 108/131 X |
| 5,109,778 | 5/1992 | Berkowitz et al. | 248/439 X |

FOREIGN PATENT DOCUMENTS

| | | | |
|---|---|---|---|
| 1076920 | 3/1960 | Fed. Rep. of Germany | 108/132 |
| 2561725 | 9/1985 | France . | |
| 2618652 | 2/1989 | France . | |
| 2624176 | 6/1989 | France . | |
| 2630312 | 10/1989 | France . | |
| 2639408 | 5/1990 | France . | |
| 2049025 | 12/1980 | United Kingdom . | |

*Primary Examiner*—Peter M. Cuomo
*Assistant Examiner*—Michael J. Milano
*Attorney, Agent, or Firm*—Polster, Lieder, Woodruff & Lucchesi

[57] ABSTRACT

A folding table includes legs which are movable between an open, unfolded position and a closed, folded position. A slide plate, having at least one edge wall, is secured to the underside of the table inwardly of the legs. A strut is pivotally secured at one end to the leg. The free end of the strut has a head formed in it which is slidable along the plate edge wall. A locking pin is mounted to the strut head and is urged against the edge wall of the plate. The wall includes an opening which receives the pin to lock the leg in its unfolded position. The end of the strut head opposite the locking pin includes a grip which is operatively connected to the pin. The table is unlocked by urging the grip inwardly. The grip is formed in two halves to define a clip which frictionally receives the leg to lock the leg in its folded position.

17 Claims, 4 Drawing Sheets

FOLDING TABLE MECHANISM

BACKGROUND OF THE INVENTION

This invention relates to folding tables, and in particular, to a mechanism which locks the table in its unfolded position and retains the leg in its folded position Folding tables are well known in the art. They commonly are used in homes, offices, training rooms, cafeterias, etc. when extra table space is needed. When not needed, the tables are folded up and stored in some unobtrusive manner.

To prevent the table from collapsing during use, folding tables commonly include some mechanism for locking the table legs in their unfolded position Some of these locking mechanisms do not securely lock the legs open and may be prone to folding during use. See for example British Patent No. 2,049,025. Some designs may also lead to accidental finger pinches while unlocking the mechanism. Again, reference may be made to the just mentioned British patent, as well as to Heinzel, U.S. Pat. No. 4,561,622. Other mechanisms available in the prior art, while suitable for their intended purposes, are complicated in construction or expensive in their manufacture, or both.

To prevent the legs from accidentally unfolding during transportation of the table or while the table is stored, it is also desirable to hold the legs in their closed, unfolded position.

SUMMARY OF THE INVENTION

One of the objects of this invention is to provide a foldable table wherein the legs can be held in their folded position and locked in their unfolded position.

Another object is to provide such a table having an operational mechanism which is sturdy in use.

Another object is to provide a locking mechanism for the table which reduces the possibility of finger pinches when unlocking the legs from either their folded or unfolded positions.

Another object is to provide such a locking mechanism which is easy to use.

Another object of this invention is to provide a simplified folding mechanism for a table.

Other objects will become apparent to those skilled in the art in light of the following description and accompanying drawings.

In accordance with the invention, generally stated, a folding table is provided with a simplified operating mechanism. The table includes a table top, legs pivotally connected to a bottom surface of the table top so as to be movable between an open unfolded position and a closed folded position, struts pivotally connected at one end to the legs, and having a head at their other end. A bracket or slide plate is secured to the table bottom surface and defines an elongate edge which slidably receives the strut head. In the preferred embodiment, the edge is formed to define a "C" shaped channel. A single mechanism locks the legs in their folded and unfolded positions and unlocks the legs from their unfolded positions. The channel includes a side wall having an opening along an end thereof proximate the attachment with the table leg. The strut head includes spring biased pins which are received in the bracket holes to lock the legs in their unfolded positions. Opposite the pins, the struts include grips which are connected to the pins and pull the pin inwardly and outwardly of the bracket opening to unlock the legs from their unlocked position. The grips also form a clip which frictionally receives the leg to lock the leg in its folded position.

DESCRIPTION OF THE PREFERRED EMBODIMENT

Figure 1:
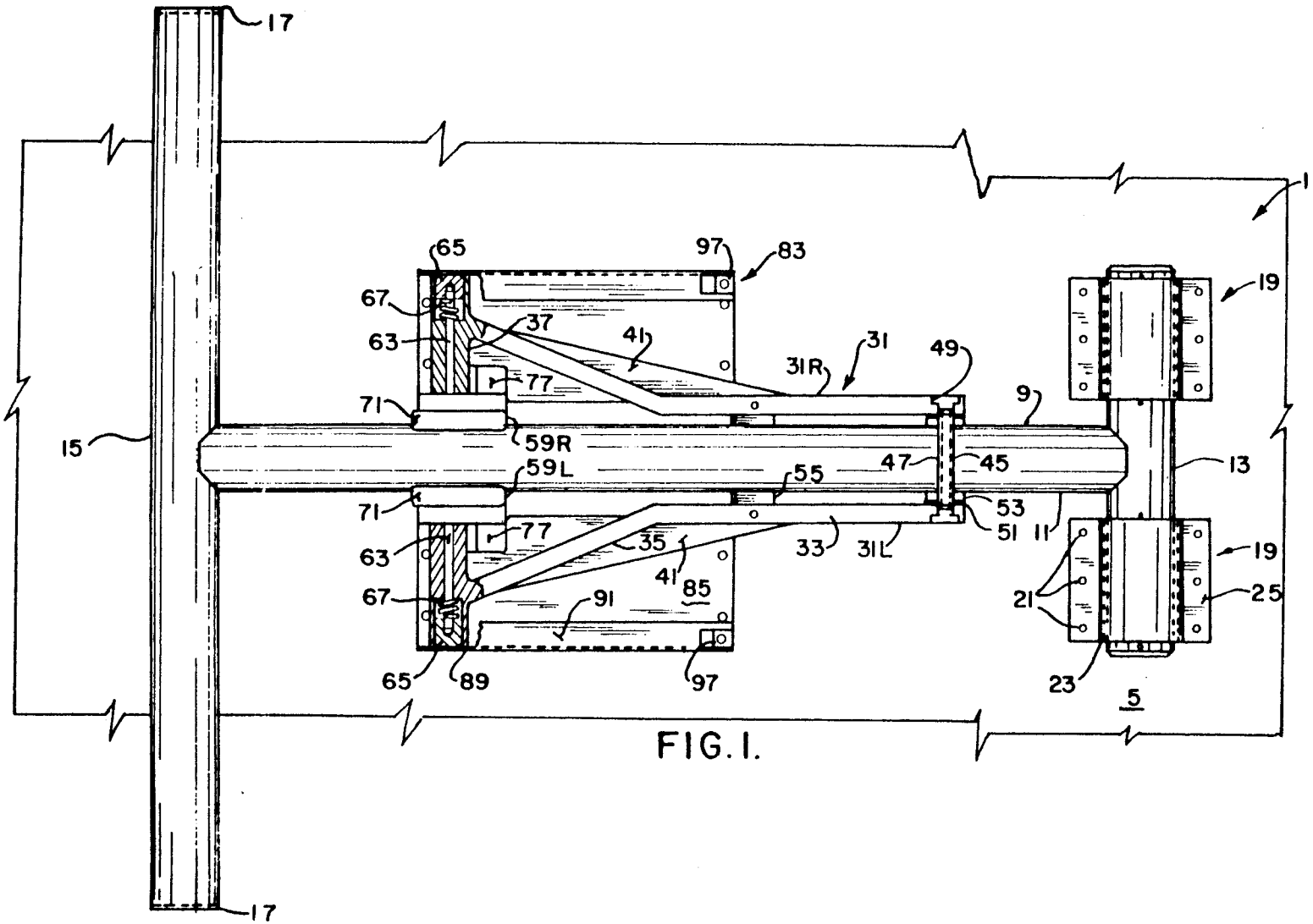
FIG. 1 is a plan view of a table leg and locking mechanism, partly in cross-section and partly broken away, showing the illustrative embodiment of locking means of this invention, the leg being shown in its folded position.

Referring to the Figures, reference numeral 1 generally refers to a folding table of the present invention. Table 1 includes a table top 3 having a bottom surface 5 and a top surface 7. A pair of legs 9, only one of which is shown for ease of description, are placed opposite one another along the bottom 5 of table 1. Each leg 9 is pivotally mounted to table bottom 5. Legs 9 include a tube 11 having a head 13 and a foot 15 attached thereto, which in the preferred embodiment are made from cylindrical tubing. The end of foot 15 is closed by a cap 17 which is brazed into the tubes. Head 13 receives a platic cap. Head 13 and foot 15 are perpendicular to tube 11 and are intersected thereby at their approximate midpoints. Foot 15 and head 13 are sufficiently long so that the table will be sturdy and stable in the unfolded position of the legs 9. The head 13, of course, defines the support surface for the table 1 in the unfolded position of the leg 9.

The head 13 of each leg 9 is secured to table 3 by a pair of leg mounts 19. The mounts 19, in turn, are attached to the table 1 in any convenient way. Conventional screws 21 or the like, work well, for example. Each leg mount 19 receives one side of leg head 13 and defines a pivotal attachment for the leg 9 with respect to the table 3. Mounts 19 include a generally circular sleeve 23. Sleeve 23 is not a complete circle, but forms an arc of approximately 280°–335°. Sleeve 23 also has flanges 25 extending outwardly from it, along opposite sides of sleeve 23 at the ends of the arc. Sleeve 23 thus has an open bottom. Sleeve 23 and flange 25 are preferably extruded aluminum and have a coating 26 of Plastisol formed thereon, preferably by dip coating. Screws 21 pass through flanges 25 to secure mounts 19 to table 3. To eliminate the play at the connection of the leg to the table, a bushing 27, made preferably from extruded plastic, is split and snapped onto leg head 13. Because the bushing can be made of varying thicknesses, it, in effect, provides a variable diameter, which can be chosen to eliminate the play without impeding the ability of the head to rotate in sleeve 23. Various diameter heads 13 can thus also be accommodated to provide for tables having legs of varying dimensions and shapes.

Figure 2:
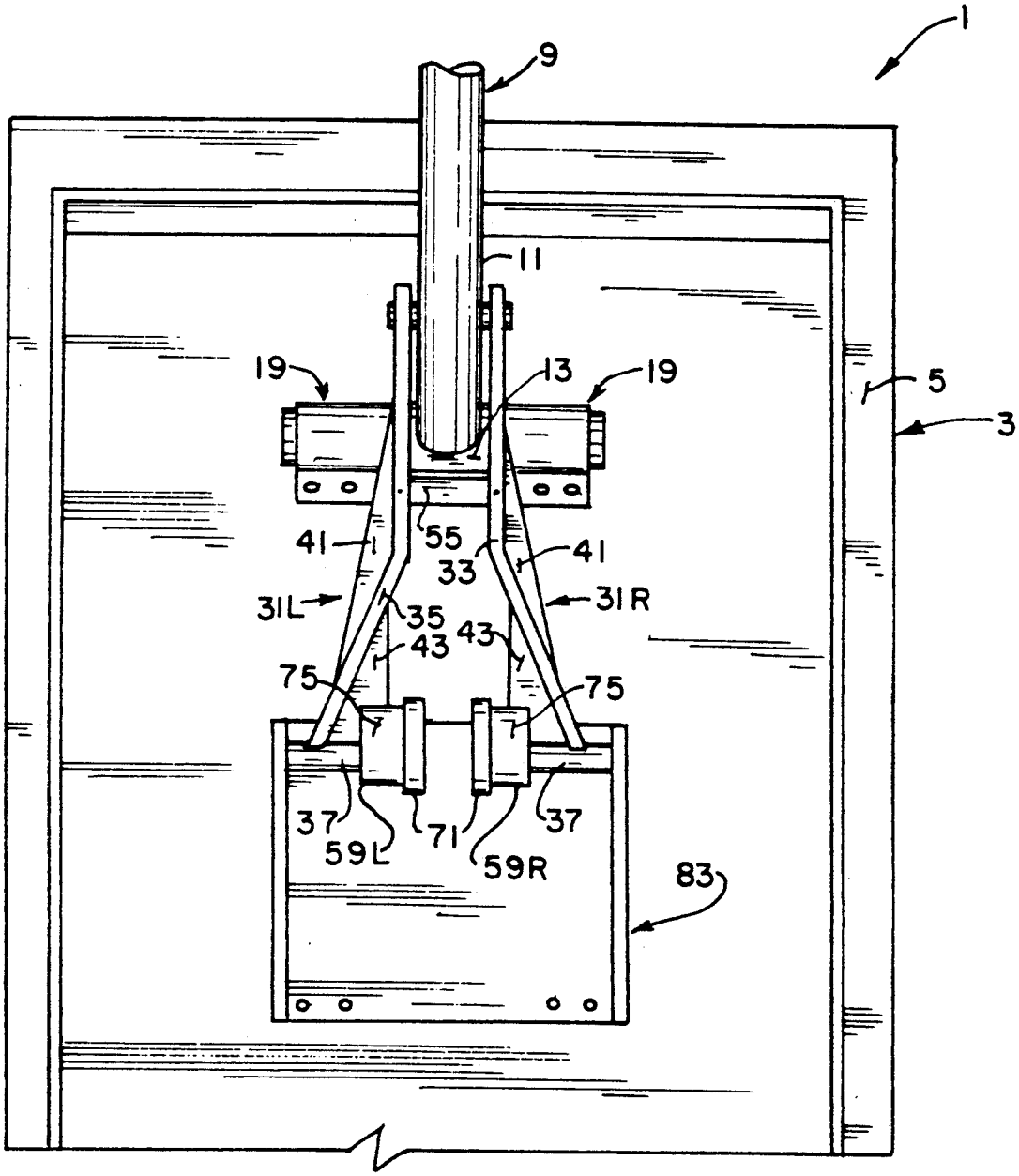
FIG. 2 is a perspective view of the table leg and locking mechanism of FIG. 1 shown in an unfolded locked position of the table leg.
Figures 3, 4, 5, 12, 13, 14, 15:
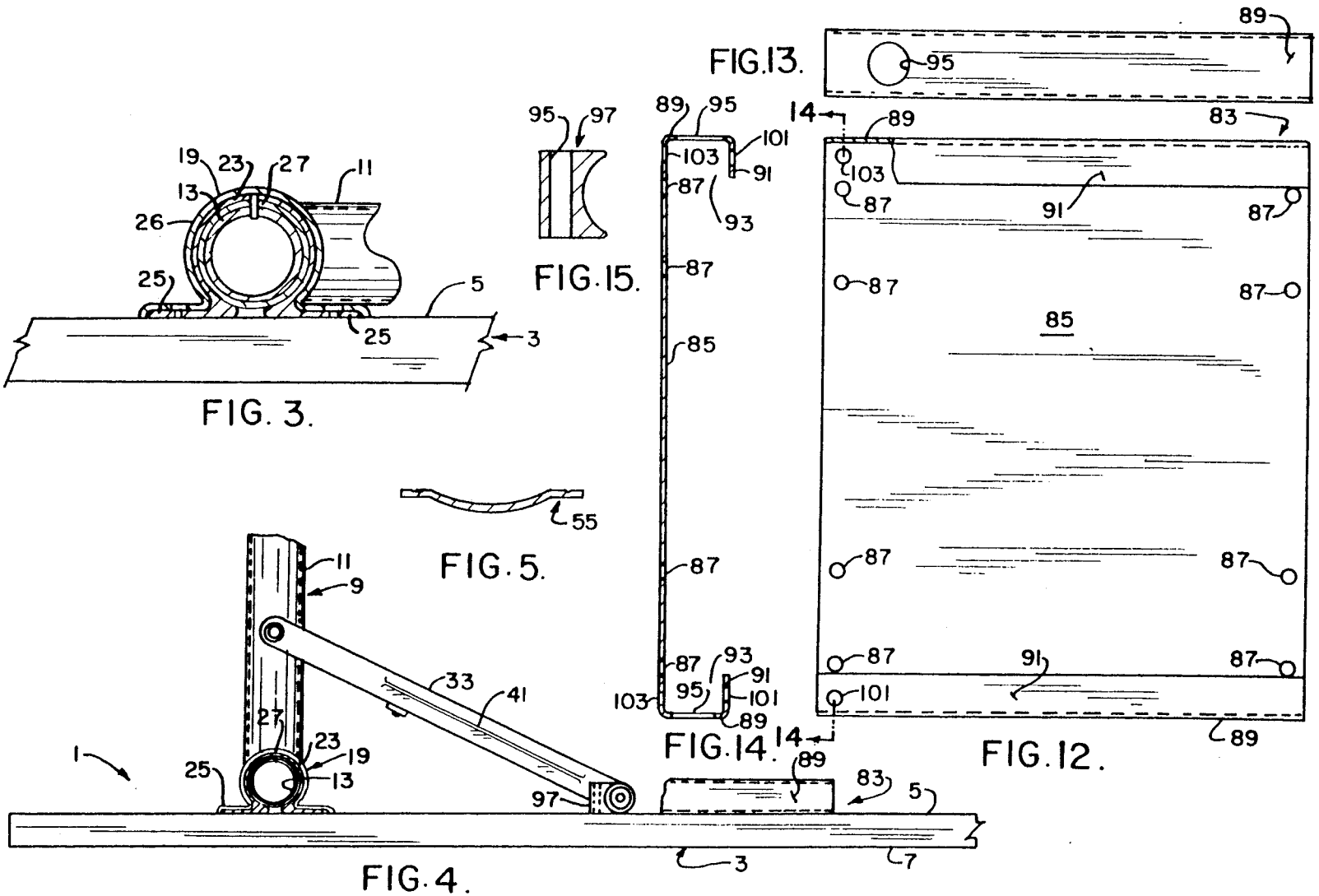
FIG. 3 is a cross-sectional view of leg mounting employed to secure the table legs to the table.
FIG. 4 is a side elevational view of the table in its unfolded position, partly in cross-section and partly cut away.
FIG. 5 is a cross-sectional view of a spacer bracket used in conjunction with the embodiment of FIG. 1.
FIG. 12 is a plan view of a slide plate used in conjunction with the embodiment of FIG. 1.
FIG. 13 is a side elevational view of the slide plate.
FIG. 14 is a cross-sectional view of the slide plate taken along line 1413 14 of FIG. 12.
FIG. 15 is a cross-sectional view of a stop bumper employed with the embodiment of FIG. 1.

A strut structure 31 is pivotally connected to leg tube 11 at an appropriate distance along tube 11 from head 13. Strut structure 31 includes a right strut 31R and a left strut 31L, which are identical. Struts 31R and 31L preferably cast as a single piece. Each of the struts 31R and 31L includes a portion 33 which is generally parallel to leg tube 11 when leg 9 is folded and a portion 35 which angles away from leg 9 in the folded position of the leg. Struts 31R and 31L are secured to opposite sides of leg 11 by an axle 45 which extends through an axle journal 47 in leg 11. Strut portions 33 have recessed bolt holes 49 to connect strut 31 to axle 45. A flat washer 51 and a cove washer 53 are placed between strut portion 33 and leg member 11. Struts 31L and 31R are further connected by a spacer bracket 55, best observed in FIG. 2, which is secured to the strut 31L and 31R. Bracket 55 is curved inwardly toward table surface 5 when legs 9 are folded.

Figures 6, 7, 8, 9, 10, 11:
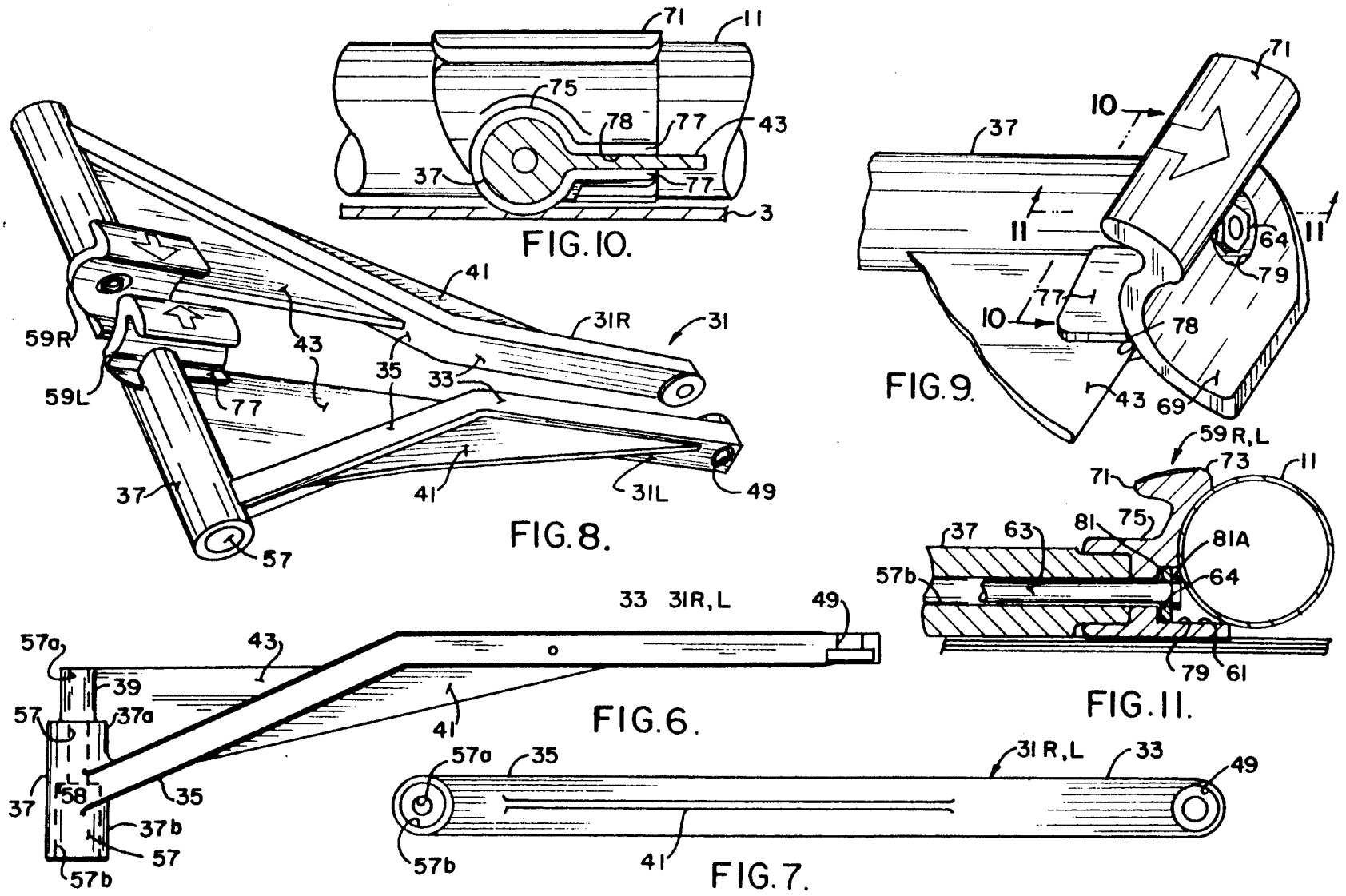
FIG. 6 is a plan view of a strut.
FIG. 7 is a side elevational view of the strut shown in FIG. 6.
FIG. 8 is a perspective view of a pair of struts with grips attached thereto to form a clip.
FIG. 9 is a perspective view of a grip attached to a strut.
FIG. 10 is a sectional view taken along line 10—10 of FIG. 9.
FIG. 11 is a cross-sectional view taken along lines 11—11 of FIG. 9.

Referring now to FIG. 6, a hollow cylindrical head 37 is formed in the distal end of portion 35 of each strut 31L and 31R and angled with respect thereto so as to be perpendicular to portion 33 of the struts. Strut head 37 is intersected by portion 35 to define an inside portion **37*a* and an outside portion 37*b*. Inside portion 37*a* is longer than outside portion 37*b*. Strut head inside portion 37*a* is stepped inwardly near its end, as at 39. A first strengthening web 41 extends along the outside of each strut 31L and 31R. A second strengthening web 43 extends between portion 35 and head 37**.

Strut heads 37 are hollow and define a bore 57 which is formed of two diameters. A first part **57*a* extends from the inner end 37*a* to a predetermined point. At that predetermined point, bore 57 widens, to define a shoulder 58. Grips 59R and 59L are secured to heads 37 of struts 31R and 31L respectively. A bolt hole 61 is formed in each grip. The bolt holes 61 are sized to receive a bolt 63. Bolt 63 passes through bore 57 and extends through bore 57*a*. Bolt 63 is attached to a locking pin 65 as best seen in FIG. 1. Pin 65 is at least partly received in bore 57*b*. A spring 67 is received in bore 57*b* and is compressed between pin 65 and shoulder 58 to bias pin 65** outwardly.

Each grip 59R and 59L includes a forward curved surface 69 having a radius sized to receive leg tube 11. A finger grip 71 extends backwardly from the top of surface 69. The junction of grip 71 and surface 69 is curved, as at 73, rather than sharp. A boss 75 extends rearwardly from the back of surface 69 and is sized to receive strut head 37 so as to be axially slidable thereon. Boss 75 has a pair of spaced surfaces 77 extending perpendicularly therefrom defining a channel 78 parallel to the grip. Surfaces 77 are spaced a sufficient distance apart so that web 43 can be slidably received in channel 78 and surfaces 77 can slide with respect to web 43.

The bolt hole 61, in the respective grips 59R and 59L, is recessed with respect to surface 69 and has a wider portion 79 defining a shoulder 81. Bolt head 64 is received in bore portion 79 and rests against shoulder 81. A washer 81A is placed between shoulder 81 and bolthead 64. Thus, the grips are translationally connected to lock pins 65 by bolt 63. When a grip is urged inwardly, pin 65 is pulled inwardly into strut portion 37. Because spring 67 is sandwiched between lock pin 67 and shoulder 58 of bore **57*b*, it biases pin 65 outwardly and pulls its respective grip against strut head 37 and web 43**.

A slider plate 83 is secured to the bottom 5 of table top 3 in a predetermined position with respect to leg mounts 19. Slider plate 83 includes a base 85 having a plurality of screw holes 87 along the forward and rearward edges thereof. Holes 87 receive threaded fasteners, for example, to secure plate 85 to surface 5. A side wall 89 extends upwardly from base 85 along each other edge thereof. In the embodiment illustrated, the side walls 89 have integrally formed, inwardly extending portions 91 which define a "C" shaped channel 93. Locking pins 65 are slidably received in channels 93. As legs 9 are moved between their folded and unfolded positions, strut 31 moves laterally, held against table surface 5 by the interaction of strut head 37 with channels 93.

Channel walls 89 have pin receiving openings 95 formed in them, positioned near the end of wall 89 proximate leg mount 19. When legs 9 are folded, pins 65 are at the end distant from openings 95. As legs 9 are unfolded, strut head 37, and hence pins 65, move toward leg mount 19 and channel pin hole 95. When pins 65 reach holes 95, the pins 65 are urged into holes 95 by springs 67 to lock legs 9 in their upright position. Slider plate 83 is positioned on table bottom 5 so that legs 9 are perpendicular to table top 3 when legs 9 are locked. Stop blocks 97 are placed at the end of channels 93 adjacent pin holes 96. Blocks 97 have screw holes 95 therethrough which are aligned with screw holes 101 in channel top 99 and 103 in base plate 85. Stop block 97 prevents strut head 37 from sliding out of channel 93 during operation of the folding mechanism.

To fold legs 9, grips 59R and 59L are urged together by hand pressure on finger grips 71. Movement of grips 71 pulls pins 65 out of pin holes 95. Legs 9 may then be folded. Because grips 71 extend away from table surface 5 and are easily gripped to unlock legs 9, the possibility of accidental finger pinches is reduced. Channels 93 are sufficiently long that strut heads 37 will not slide out of channel 93 when table 1 is being folded.

Strut heads 37 are of a length sufficient to space grips 59R and 59L apart a distance equal to the outer diameter of leg tube 11. Thus, when folded, leg tube 11 is received between grips 59R and 59L to lock legs 9 in their folded position. Grips 59R and 59L thus also function as a clip. Legs 9 frictionally engage grip clip 59. When being folded, leg tube 11 urges grips 59R and 59L, and hence strut halves 31R and 31L, apart as it slides over curved edge 73. When tube 11 passes edge 73, the strut halves spring back together, urging the grips together to hold leg 9 in place. The strut 31 thus acts to hold the legs against the table surface. Bores 79 of grips 59R and 59L are sufficiently deep to allow grips 59R and 59L to slide over strut head 37 and web 43 so that the two halves can be separated to receive leg tube 11.

Similarly bore 75 and channel 78 are sufficiently deep to allow this motion of the grips. To unfold table 1, the legs are simply pulled out of grip clip 59. As can be appreciated, the same structure is used to lock legs 9 in both their folded and unfolded positions and to unlock legs 9 from their folded positions.

When table 1 is assembled, the struts 31 distribute the load over a greater surface than do existing systems. This increases stability and performance of the table. Further, spacer bracket 55 acts as a leaf spring to offer resistance to lateral forces on the struts and secures them in position. Opposing forces of the table place the leg tube 11 in compression and the axle 45 in tension. This makes the pivot point of the strut, at the axle, stronger and more stable.

Numerous variations, within the scope of the appended claims, will be in part apparent and in part pointed out to those skilled in the art in light of the foregoing description and accompanying drawings. Merely by way of example, the design of the legs 9 may be altered. For example, the legs may be rectangular tubes, if desired. Strut designs may be varied. While the table described herein is a stand alone unit, it may be hinged to a wall at one end, for example. The stored positioned of such an embodiment merely is along the wall. Only a single folding mechanism is required in that kind of arrangement. The design of plate 83 may be altered. For example, while channel 93 is described as being "C" shaped, other shapes may be used, if desired. These variations are merely illustrative.

Having thus described the invention, what is claimed and desired to be secured by Letters Patent is:

1. A foldable table including:

a table top;

leg means pivotally connected to a bottom surface of said table top to be moved between an open unfolded position and a closed folded position;

strut means pivotally connected at one end to said leg means and having a head at another end thereof;

bracket means secured to said table bottom surface defining an elongate channel, said strut head being slidably received in said channel;

means for locking said leg means in said unfolded position;

means for unlocking said leg means from said unfolded position; and clip means, comprising said unlocking means, for holding said leg means in said folded position.

2. The table of claim 1 wherein said bracket means includes a side wall having an opening at an end thereof proximate said leg means, said means for locking said leg in said unfolded position comprising pin means on said strut head, said pin means being received in said side wall opening.

3. The table of claim 2 wherein said pin means is biased outwardly.

4. The table of claim 3 wherein said means for unlocking said legs from said unfolded position includes grip means connected to said locking pin means to pull said pin means inwardly and out of said side wall opening.

5. A foldable table including:

a table top;

a leg means pivotally connected to a bottom surface of said table top to be moved between an open unfolded position and a closed folded position;

strut means pivotally connected at one end to said leg means and having a head at another end thereof;

bracket means secured to said table bottom surface defining an elongate channel, said strut head being slidably received in said channel;

means for locking said leg means in said unfolded position including outwardly biased pin means;

means for unlocking said leg means from said unfolded position including grip means connected to said locking pin means to pull said pin means inwardly and out of said side wall opening; and means, comprising said unlocking means, for holding said leg means in said folded position including said grip means; said grip means defining a clip means which snappingly receives said leg means to lock said leg means in said folded position.

6. The table of claim 5 wherein said strut means includes a left half and a right half, each said half having one of said grip means secured to its respective strut head, each said grip means having an inner curved surface, said clip means comprising said strut left grip means and said strut right half grip means.

7. The table of claim 6 wherein said strut biases said clip means against said leg when said leg is in said folded position.

8. In a foldable table including a table top and leg means pivotally secured to a bottom surface of said table top to move between a folded position and an unfolded position, the improvement comprising a strut pivotally connected to said leg means at one end and slidably connected to a bracket means at another end, said bracket means being secured to said table bottom surface; said strut including means for locking said leg means in said unfolded position and a clip means for holding said leg means in said folded position.

9. The improvement of claim 8 wherein said first and second means are interconnected.

10. The improvement of claim 8 wherein said strut includes a right strut half and a left strut half, each said strut half having a hollow head which is received in said bracket means, said unfolded locking means comprising a locking pin received in at least one of said strut halves, said locking pin being biased outwardly; said bracket means including a side wall having an opening therethrough which receives said locking pin to lock said leg means in an unfolded position.

11. The improvement of claim 10 wherein a grip is slidably secured to an inner end of said strut halves; at least one of said grips being in mechanical communication with said locking pin; said grip comprising means for unlocking said leg means from said unfolded position.

12. In a foldable table including a table top and leg means pivotally secured to a bottom surface of said table top to move between a folded position and an unfolded position, the improvement comprising:

a strut pivotally connected to said leg means at one end and slidably connected, at another end, to a bracket means secured to said table bottom surface; said strut including means for locking said leg means in said unfolded position and means for holding said leg means in said folded position; said strut comprising a right strut half and a left strut half, each said strut half having a hollow head which is received in said bracket means, said unfolded locking means comprising a locking pin received in at least one of said strut halves, said locking pin being biased outwardly; said bracket means including a side wall having an opening therethrough which receives said locking pin to lock said leg means in an unfolded position;

a grip slidably secured to an inner end of said strut halves; at least one of said grips being in mechanical communication with said locking pin; said grip comprising means for unlocking said leg means from said unfolded position; each said grip having an inner surface shaped complimentary to said leg means, said grips coacting to defining a clip when said leg means are in said folded position; said folded position locking means comprising said grips.

13. In a foldable table including a table top and leg means pivotally secured to a bottom surface of said table top to move between a folded position and an unfolded position, the improvement comprising a single means including means for locking said leg means in said unfolded position and clip means for holding said leg means in said folded position, struts pivotally connected to opposite sides of said leg means, said locking and holding means including a head on each of said struts, said heads being slidable in a bracket secured to said table; each said head having a grip; and a locking pin slidably received in at least one of said heads at an end opposite the grip of said head.

14. The improvement of claim 13 wherein said bracket includes a side wall having a locking pin receiving opening therein; said locking pin being biased against said bracket side wall, said side wall opening receiving said locking pin to lock said leg means in said unfolded position.

15. In a foldable table including a table top and leg means pivotally secured to a bottom surface of said table top to move between a folded position and an unfolded position, the improvement comprising:

a single means for locking said leg means in said unfolded position and for holding said leg means in said folded position;

struts pivotally connected to opposite sides of said leg means, said locking and holding means including a head on each of said struts, said heads being slidable in a bracket secured to said table;

each said head having a grip, said grips have inner surfaces shaped to receive said leg means, said grips coacting to define a clip means which frictionally holds said leg means in said folded position; and a locking pin slidably received in at least one of said heads at an end opposite the grip of said head; said bracket including a side wall having a locking pin receiving opening therein; said locking pin being biased against said bracket side wall, said side wall opening receiving said locking pin to lock said leg means in said unfolded position.

16. The improvement of claim 15 said table further including means for unlocking said table from said unfolded position, said unlocking means including the grip of said head having said locking pin; said grip being slidable with respect said head; said locking pin being operationally connected to the grip, said grip removing said pin from said bracket wall opening when said grip is urged inwardly.

17. The improvement of claim 16 wherein said slidable grip facilitates the operation of said clip to hold said leg means in said folded position.

* * * * *